United States Patent [19]

Shindome et al.

[11] 4,351,252

[45] Sep. 28, 1982

[54] METHOD FOR TREATING WATER SOLUTION OF WASTE MATERIAL CONTAINING SALT OF SMELT-WATER EXPLOSION CHARACTERISTIC

[75] Inventors: Mamoru Shindome; Takanori Yanagita; Takanori Nakamura; Hiroyuki Otsuji, all of Nobeoka, Japan

[73] Assignee: Asahi Engineering Co. Ltd., Osaka, Japan

[21] Appl. No.: 238,326

[22] Filed: Feb. 26, 1981

Related U.S. Application Data

[62] Division of Ser. No. 21,538, Mar. 19, 1979, Pat. No. 4,280,982.

[30] Foreign Application Priority Data

Mar. 23, 1978 [JP] Japan ..... 53-32302
Mar. 23, 1978 [JP] Japan ..... 53-32303

[51] Int. Cl.[3] ..... F23G 5/12
[52] U.S. Cl. ..... 110/346; 110/171; 110/237; 110/238; 422/185
[58] Field of Search ..... 110/237, 238, 346, 171; 175/24; 422/185

[56] References Cited

U.S. PATENT DOCUMENTS 3,833,354 9/1974 Thummler et al. ..... 74/24
4,198,914 4/1980 Petiot ..... 110/238
4,301,747 11/1981 Lockwood, Jr. et al. ..... 110/171

FOREIGN PATENT DOCUMENTS 51-38185 12/1976 Japan .
52-36354 3/1977 Japan .

*Primary Examiner*—Edward G. Favors
*Attorney, Agent, or Firm*—Sprung, Horn, Kramer & Woods

[57] ABSTRACT

An apparatus for treating a water solution of a waste material containing a salt with smelt-water explosion characteristics comprises an open-bottomed incinerator and a gas-liquid separator disposed beneath the incinerator in fluid-flow communication therewith. The waste solution is sprayed into the incinerator and heated therein so that the salt in the solution is fused, water vaporized and organic components of the solution burned. The combustion gases and water vapor flow downwardly into the separator, while the fused salt forms a deposit on the inner surface of the incinerator and flows downwardly into the separator. At the junction between the incinerator and separator, cooling water is fed to the fused salt so that the deposit of salt is solidified and cracked into separate masses which fall together with the cooling water onto an inclined baffle member disposed in the separator and roll downwardly on the baffle member. A flow of water is formed on the baffle member to such a depth that the salt masses are only partially dipped in the water and are substantially cooled during its travel on the baffle member. The gaseous mixture flowing from the incinerator into the separator flows therethrough substantially horizontally to a gas outlet formed in the separator above a liquid outlet formed in the bottom of the separator.

1 Claim, 7 Drawing Figures

METHOD FOR TREATING WATER SOLUTION OF WASTE MATERIAL CONTAINING SALT OF SMELT-WATER EXPLOSION CHARACTERISTIC

This is a division of application Ser. No. 021,538, filed Mar. 19, 1979 now U.S. Pat. No. 4,280,982.

BACKGROUND OF THE INVENTION

1. Field of the Invention

The present invention relates generally to method and apparatus for handling waste and, more particularly, to method and apparatus for treating a water solution of a waste material containing a salt having smelt-water explosion characteristics.

2. Description of the Prior Art

It has been known that explosions can occur in the situation where a mass of a molten or fused sodium or potassium chloride is dipped or submerged at a high termperature into water. The explosion of this class is called "smelt-water explosion". The salt of the kind specified is called "salt having smelt-water explosion characteristics". A salt of the class specified above is contained in waste produced in the pulp industry, for example.

Japanese Post-Examination Patent Publication No. 51-38185 (published Oct. 20, 1976), No. 52-13673 (published Apr. 15, 1977) and No. 52-36354 (published Sept. 14, 1977) are all concerned with method and apparatus for treating a water solution of a waste material containing a salt having smelt-water explosion characteristics. The apparatus disclosed in these Japanese publications comprises an incinerator and a gas-liquid separator. The incinerator defines therein an open-bottomed combustion chamber and is provided with at least one spray nozzle through which the waste solution is sprayed into the combustion chamber. The incinerator is also provided with a substantially downwardly directed fuel burner for producing a combustion of a fuel in the combustion chamber to heat the spray of the solution to a temperature at which the water in the sprayed solution is vaporized and the salt contained in the sprayed solution is fused. Any organic component of the waste material is burned away in the combustion chamber. The combustion gases and the water vapor thus produced flow through the combustion chamber toward the open bottom thereof. At least a part of the fused salt forms a deposit on the inner surface of the combustion chamber and flows toward the open bottom.

The gas-liquid separator comprises a substantially closed vessel provided with an inlet substantially vertically aligned with the open bottom of the combustion chamber in the incinerator, a gas outlet and a liquid outlet formed in the vessel and disposed at positions remote from the inlet in generally horizontal direction. The open bottom of the combustion chamber and the inlet of the gas-liquid separator vessel are connected by a substantially vertical cylindrical duct or annular wall. The fused salt flows downwardly on the inner surface of the annular wall. Cooling water is introduced through the annular wall into contact with a part of the surface of the fused salt flowing on the inner surface of the wall so that the salt is cooled and at least partially solidified and cracked into separate masses which fall into the gas-liquid separator vessel. A part of the cooling water thus introduced is vaporized and the rest of the water falls down into the gas-liquid separator vessel. The combustion gases and the water vapor flow in the vessel is generally horizontal direction toward the gas outlet.

The masses of salt are further cooled in the separator vessel by water and dissolved in the cooling water, so that the salt can be recovered in the form of an aqueous solution thereof.

In the Japanese publications referred to above, references are made to the mechanism of the "smelt-water explosion". It is stated that the mechanism of the smelt-water explosion has not been exactly known but is believed to be due to the fact that, when a mass of a fused salt having smelt-water explosion characteristics is dipped at a high temperature into and surrounded by water, the water permeates into the mass of the fused salt. Simultaneously, the fused salt is cooled to form a relatively hard, smooth and continuous gas-tight skin or shell in the surface area of the mass of the salt with a result that the water which has permeated into the salt is trapped within the hard 'shell". The inner part of the mass of the salt, however, is still at a temperature high enough to vaporize the trapped water. The vaporization of the water causes an abrupt pressure build-up within the hard "shell" resulting in an explosion. In addition to sodium chloride and potassium chloride referred to above, sodium hydroxide and sodium sulfide are also known as being inorganic salts which have the smelt-water explosion characteristics. Sodium carbonate and sodium sulfate are also inorganic salts, but they are known as being free from the smelt-water explosion. The reason is believed to be that the skins or shells of the masses of fused sodium carbonate and sulfate formed when they are dipped into and cooled by water are softer than the shells of the masses of salts having the smelt-water explosion characteristics and thus allow the vaporized water to easily break out and flow from the softer shells without causing an explosion.

In the apparatus disclosed in Publication No. 52-13673, the partially solidified and cracked masses of fused salt fall directly onto the bottom of the gas-liquid separator vessel together with a part of the cooling water introduced through the annular wall. Thus, a bath of the water is formed in the vessel to a certain depth. The masses of salt which fall onto the vessel bottom are dipped in and contacted by the water. In order to avoid explosion, therefore, the apparatus must be arranged such that the water supply is so controlled as to assure that, by the time the masses of salt fall into the water bath, they are sufficiently cooled to a temperature at which no explosion takes place, i.e., a temperature at which no rapid vaporization of the water trapped within the masses of salt occurs.

The Japanese Publication No. 52-13673 also teaches that, even in the case where a mass of fused sodium or potassium chloride is cooled by direct contact with water, the possibility of dangerous smelt-water explosion can be minimized if the mass is dipped in water not entirely or wholly but only partially. The reason is believed to be that the water vapor produced from the water trapped in the mass of fused salt can flow out of the mass through that portion of the mass which is not in contact with the water and thus is still soft enough to permit the passage of the water vapor.

In the apparatus disclosed in the Japanese Publication No. 51-38185 and No. 52-36354, a perforated horizontal partition is provided in the gas-liquid separator vessel to divide the interior thereof into upper and lower spaces for the gases and liquid, respectively, so that masses of salt which fall on the partition are prevented from being dipped in the bath of the cooling water formed on the bottom of the separator vessel. A conical "dispersion" member is disposed on the horizontal partition in vertical alignment with the annular wall so that the cooling water which falls into the gas-liquid separator is rapidly dispersed therein radially outwardly.

SUMMARY OF THE INVENTION

It is a primary object of the present invention to ensure that a fused salt having smelt-water explosion characteristics and produced in the course of handling a waste can surely be cooled by water without causing any destructive explosion whereby the salt can be recovered in the form of an aqueous solution thereof.

According to one feature of the present invention, there is provided an improved apparatus for treating a water solution of a waste material containing a salt having smelt-explosion characteristics, the apparatus comprising: an incinerator defining therein an open-bottomed combustion chamber and provided with at least one spray nozzle through which the solution is sprayed into the combustion chamber, and a substantially downwardly directed fuel burner for producing a combustion of a fuel in the combustion chamber to heat the spray of the solution to a temperature at which the water in the sprayed solution is vaporized and the salt contained in the sprayed solution is fused, the combustion gases and the water vapor thus produced flowing through the combustion chamber toward the open bottom thereof, at least a part of the fused salt forming a deposit on the inner surface of the combustion chamber and flowing toward the open bottom thereof; a gas-liquid separator comprising a substantially closed vessel provided with an inlet substantially vertically aligned with the open bottom of the combustion chamber, a gas outlet and a liquid outlet, the gas and liquid outlets being remote from the inlet in generally horizontal direction; means connecting the open bottom of the combustion chamber to the inlet of the vessel to provide a fluid-flow communication therebetween so that the combustion gases and the water vapor flow from the combustion chamber into the vessel, the combustion gases and the water vapor flowing in the vessel generally horizontally toward the gas outlet, the fused salt which forms the deposit falling from the combustion chamber through the inlet into the vessel by gravity, the improvement which comprises:

a baffle member disposed in the vessel and having an inclined surface intersecting the vertical axis of the inlet so that the salt falls onto the inclined surface, the angle of inclination of the inclined surface to the horizontal ranging from 5° to 60° C.; and means for establishing a flow of water on the inclined surface, the arrangement being such that the water flow is of such a depth that the salt falling onto the inclined surface is only partially dipped in the water flow and is moved on the inclined surface generally toward the liquid outlet while being cooled by the water flow.

According to another feature of the present invention, there is provided an improved method of treating a water solution of a waste material containing a salt having smelt-explosion characteristics, the method including the steps of spraying the waste solution into an open-bottomed incinerator, producing a combustion of a fuel in the incinerator to heat the spray of the waste solution to a temperature at which the water in the sprayed solution is vaporized and the salt contained in the sprayed solution is fused, causing at least a part of the fused salt to form a layer on the inner surface of the incinerator, allowing the fused salt in the layer to flow downwardly by gravity through the open bottom of the incinerator, and cooling the fused salt to a temperature at which no explosion occurs, wherein the improvement comprises:

establishing an inclined flow of cooling water which is disposed below the open bottom of the incinerator and intersects the vertical axis of the open bottom so that the fused salt falls down onto the inclined water flow and which is of such a depth that the fused salt falling onto the water flow is only partially dipped in the water, the angle of inclination of the water flow relative to the horizontal ranging from 5° to 60°.

The present invention is based on a discovery that, contrary to the teaching by the Japanese Publication 52-13673, a smelt-water explosion tends to occur even with a partially dipped mass of a fused salt if the same section of the mass is kept in contact with water continuously for a certain period of time. This seems to be for the reason that, if the same section of a mass of fused salt is continuously contacted by water, the section of the salt is rapidly solidified and an increased amount of water is trapped in the solidified mass of salt. In fact, the tendency of the occurence of explosion is increased with a fused salt having a poor fluidity or such a characteristic that a mass of the salt will grow in size. However, it has been found that no explosion takes place when masses of fused salt are dropped onto a water flow formed on an inclined surface and are caused to move downwardly together with the water in such a manner that the masses of salt roll down on the inclined surface. It has also been found that the depth of the water flow on the inclined surface should be such that the mass of the salt is only partially dipped in the water. The rolling of a mass of salt on the inclined surface and in the water flow thereon moves successive portions or surface areas of the mass into contact with the water with a result that the solidification in each of the respective surface area of the mass of salt is slowed down compared with the case where the same surface area of a mass of salt is continuously in contact with water. With an inclined surface having an angle of inclination to the horizontal of less than 5°, the salt mass does not roll on the inclined surface with a resultant increase in the possibility of explosion. With an angle of inclination of more than 60°, no explosion takes place on the inclined surface. However, the angle of inclination of more than 60° is not preferred from the structural point of view.

The present invention is also based on a discovery that a mass of salt of smaller or lighter than 3 grams when dropped directly into water does not cause any destructive and dangerous explosion and that, although the magnitude of explosion is increased with the increase in the size of the masses of salt, the treatment of a waste solution containing sodium or potassium chloride hardly produces masses of the salt of larger or heavier than 35 grams.

The above and other objects, features and advantages of the present invention will be made more apparent by the following description with reference to the accompanying drawings.

DESCRIPTION OF PREFERRED EMBODIMENTS

Figure 1:
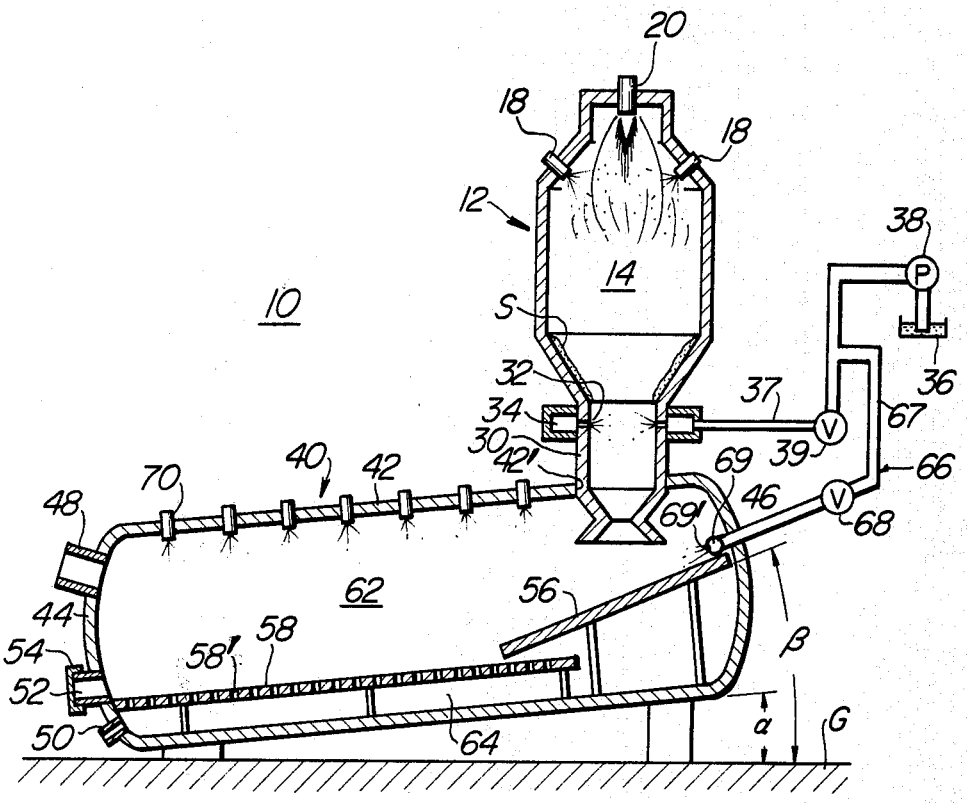
FIG. 1 is a partially diagrammatic and partially sectional side elevation of an embodiment of an apparatus for treating an aqueous waste solution according to the present invention.

Referring first to FIG. 1, an embodiment of an apparatus for treating an aqueous solution of a waste according to the present invention is generally designated by 10 and designed to handle a water solution of waste produced in pulp industry. The apparatus 10 comprises an incinerator 12 which defines therein a combustion chamber 14 having a substantially vertical axis and an open bottom. The waste solution is sprayed into the combustion chamber 14 through nozzles 18 mounted on the incinerator 12 adjacent to the top thereof. A fuel burner 20 is mounted on the top of the incinerator 12 to produce a combustion of a fuel in the combustion chamber 14 so that the sprays of the waste solution are heated in the combustion chamber 14 to a temperature higher than 800° C. at which the water in the sprayed solution is vaporized, any organic material contained in the solution is burned away and the salt contained in the solution is fused. The combustion gases and the water vapor thus produced in the combustion chamber 14 flow therein downwardly toward the open bottom thereof. At least a part of the fused salt forms a deposit s on the inner surface of the combustion chamber and flows downwardly toward the open bottom thereof. The rest of the fused salt is formed into small particles which are suspended in the flow of the mixture of the combustion gases and the water vapor.

The open bottom of the combustion chamber 14 is connected with a substantially vertical duct or annular wall 30 having a lower end portion extending into a gas-liquid separator 40 through an inlet 42'. A plurality of water jet nozzles 32 are provided in the annular wall 30 to introduce cooling water into the passage defined by the annular wall 30. The water jet nozzles 32 are in communication with a water chamber 34 formed around the outer periphery of the annular wall 30. The water chamber 34 is supplied with cooling water from a water source 36 through a pipeline 37 in which a pump 38 and a valve 39 are provided. The nozzles 32 are arranged such that the cooling water is jetted into contact with a part of the surface of the fused salt which is flowing in the form of a layer on the inner surface of the annular wall 30. The layer of the fused salt is rapidly cooled and, at the same time, subjected to shearing, so that the layer is broken into separate small pieces or masses in each of which the salt is at least partially solidified.

The cooling water is supplied to the fused salt either in the form of sprays or jets. In either case, drops or small particles of the cooling water are directed to and inpinge on the surface of the layer of the fused salt at a high speed. Thus, the layer of the fused salt is contacted by the cooling water only partially and is not completely covered with the water. The fused salt, therefore, can be cooled by the water without explosion. A part of the cooling water is vaporized by the heat of the fused salt as well by the heat of the gaseous mixture flowing downwardly through the annular wall 30. The rest of the cooling water and the partially solidified masses of salt fall through the annular wall 30 into the gas-liquid separator 40. The masses of the salt entering the gas-liquid separator 40 are partially cooled and solidified but are still at such a high temperature that a smelt-water explosion would possibly occur if the salt masses are completely surrounded by water within the gas-liquid separator 40.

The gas-liquid separator 40 comprises an axially elongated vessel including a substantially cylindrical wall 42 and end walls 44 and 46. The vessel 40 is supported on the ground G and inclined at an angle $\alpha$ to the horizontal, the angle of inclination $\alpha$ of the axis of the vessel 40 to the horizontal being 6° in the illustrated embodiment of the invention. The inlet 42' is formed in the top of the cylindrical wall 42 of the vessel 40 adjacent to the upper end wall 46. A gas outlet 48 and a liquid outlet 50 are formed in the lower end wall 44 adjacent respectively to the top side and bottom side of the cylindrical wall 42 adjacent to the lower end wall 44. The gas and liquid outlets 48 and 50 may be connected to duct and pipeline which convey the gases and liquid from the vessel 40 to remote places for further treatments of the gases and liquid. The further treatments do not form a part of the present invention and thus will not be described herein. A manhole 52 is formed in the lower end wall 44 and is normally closed by a cap or closure member 54.

A baffle member 56 comprising a substantially flat plate is disposed within the gas-liquid separator vessel 40 and positioned such that the upper surface of the baffle member 56 intersects the vertical axis of the inlet 42' and is inclined relative to the horizontal at an angle $\beta$ which is 21° in the illustrated embodiment of the invention. The inclined upper surface of the baffle member 56 extends radially outwardly beyond the vertical projection of the bottom end of the annular wall 30 so that broken masses of salt and the non-vaporized part of the cooling water fall onto the inclined baffle member 56.

A partition 58 is provided within the gas-liquid separator vessel 40 to divide the interior thereof into an upper space 62 for gases and a lower space 64 for liquid. The partition 58 is formed therein with perforations or apertures 58 to provide fluid-flow communication between the upper and lower spaces 62 and 64. In the illustrated embodiment of the invention, the partition 58 is paarallel to the bottom or lower side of the cylindrical wall 42 of the vessel 40 and has an upper section disposed beneath the lower end of the inclined baffle member 56.

The apparatus 10 further includes a second water supply means 66 comprising a second pipeline 67 having an upstream end connected to the pipeline 37 at a point upstream of the valve 39. The second pipeline 67 is provided with a second valve 68 and extends into the gas-liquid separator vessel 40 through a hole in the upper end wall 46. The downstream end of the second pipeline 67 is connected with an elongated tubing 69 which is closed at its opposite ends and extends along the upper edge of the inclined baffle member 56. Apertures or holes 69' are formed along the length of the tubing 69 so that water from the pipeline 67 is jetted through the holes 69' onto the upper surface of the baffle member 56.

The valves 39 and 68 in the water supply pipelines 37 and 67 are adjusted to control the supply of the cooling water such that there is formed on the inclined top surface of the baffle member 56 a flow of water of such a depth that masses of salt falling onto the baffle member are only partially dipped in the water flow. Because the top surface of the baffle member 56 is inclined generally toward the liquid outlet 50, substantially all of the masses of salt falling onto the baffle member 56 roll down on the baffle member while they are in contact with the water on the baffle member. The perforated partition 58 receives masses of salt from the inclined baffle member 56. When the salt masses leave the baffle member 56, they are cooled substantially to a temperature at which smelt-water explosion does not take place.

The masses of salt falling down from the baffle member 56 onto the partition 58 are further cooled by water shower produced by a series of shower nozzles 70 mounted on the top side of the cylindrical section 42 of the vessel 40 and are ultimately dissolved in the showered water. The water containing the salt dissolved therein flows down through the apertures 58' in the partition 58 into the lower, liquid space 64 and thus can be discharged therefrom through the liquid outlet 50.

The gaseous mixture which comprises the combustion gases, the water vapor and the small particles of fused salt and which flows from the combustion chamber 14 through the annular wall 30 into the cylindrical vessel 40 flows therethrough substantially horizontally toward the gas outlet 48. During the flow of the gaseous mixture through the vessel 40, the gases are not only cooled but also cleaned or "washed" by the water showered by the water shower nozzles 70 so that any solid particles and dust are removed from the gaseous flow before the gases leave the vessel 40. The salt particles suspended in the gaseous flow are dissolved in the showered water.

The size of the apertures 58' in the partition 58 is determined such that non-dissolvable solid particles such as broken pieces of refractory material from the incinerator 12 cannot pass through the partition 58. Such particles can be removed from the vessel 40 through the manhole 52.

Tests were conducted to determine the range of the inclination of the top surface of the baffle member 56 to the horizontal and the range of the depth of the water flow on the baffle member.

Test 1

Figure 2:
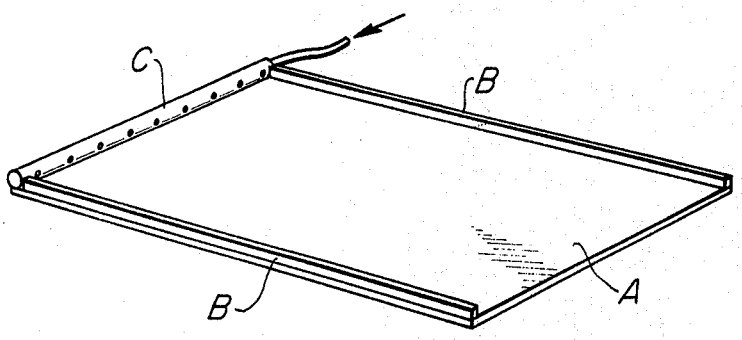
FIG. 2 is a perspective view of a flat plate used in first and second serieses of tests to determine the range of the angle of inclination of a baffle member of the apparatus shown in FIG. 1 and the range of the depth of water flow on the baffle member.
Figure 3:
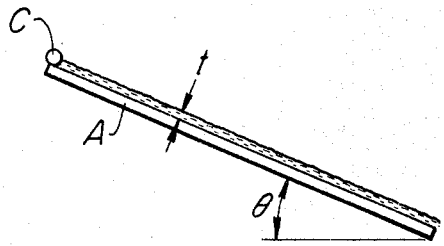
FIG. 3 is a side view of the flat plate shown in FIG. 1, the plate being shown in its inclined test position.

First series of tests were conducted with a tool comprising a flat plate A having upstanding flanges or side walls B along the side edges of the plate. A water supply tubing C, closed at one end, connected at the other end to a water supply source by a hose and provided with a plurality of apertures along its length, was attached to the plate A along one end edge of the plate. The plate A was positioned at an angle $\theta$ relative to the horizontal, as shown in FIG. 2. Water was fed through the tubing C onto the inclined upper surface of the plate A so that a water flow of a depth t was formed thereon. Weighed amounts of a salt which had smelt-water explosion characteristic and was of the class contained in a waste solution produced in pulp industry were heated to 950° C. and fused in an electric furnace and were poured onto the water flow on the plate A from above thereof. The water was at the temperature of 25° C.

The angle of inclination $\theta$ of the plate A was varied and set at 5°, 20°, 35°, 45° and 60°. For each of the different angles of inclination $\theta$ as set, the rate of the water supply was varied and set such that the depth t of the water flow on the plate A was 0.5 mm, 3 mm and 5 mm. For each of the different depths t of the water flow, different amounts of fused salt were poured onto the water flow on the plate A. The different amounts of the salt were of the classes of 1 gram, 3 grams, 5 grams, 20 grams and 30 grams. Similar tests were conducted five times for each combination of the different angles of inclination $\theta$ of the plate A, the different depths t of the water flow on the plate A and the different classes of the amounts W of the fused salt. The results of this series of tests are shown in Table 1 below.

Test 2

A second series of tests were conducted with the plate A used in the first series of tests. The angle of inclination $\theta$ of the plate A was varied and set at 5°, 20° and 35°. For each of the different angles of inclination $\theta$ as set, the water was supplied at such a rate that the water flow on the plate A was 7 mm in depth. The amounts of fused salt poured onto the flow of the inclined plate A were of five classes, i.e., 1 gram, 3 grams, 5 grams, 20 grams and 30 grams, as in the first series of tests. The results of the second series of tests are shown in table 2.

Test 3

Figure 4:
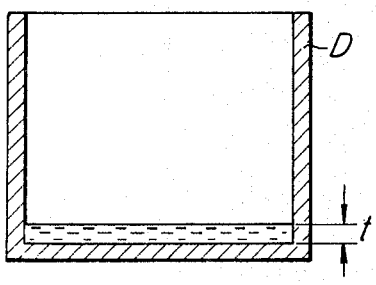
FIG. 4 is a vertical sectional view of an opentopped container used in a third series of test to determine the range of the depth of the water flow on the inclined baffle member.
Figure 5:
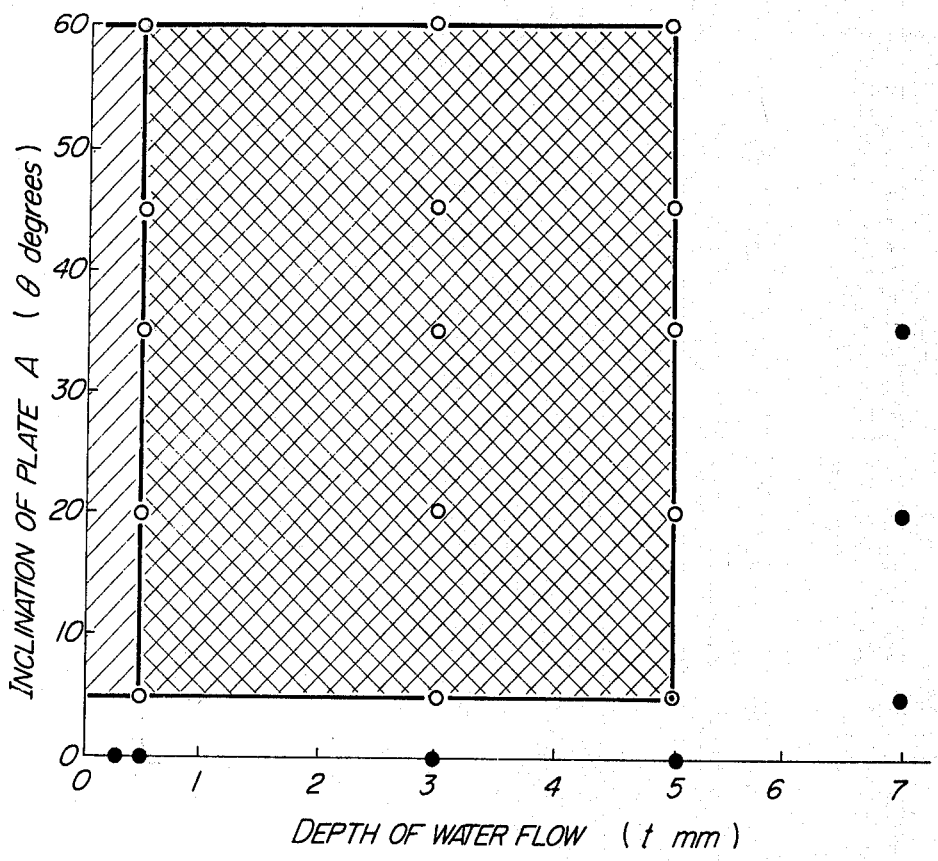
FIG. 5 graphically illustrates the results of the first to third series of tests.

A third series of tests were conducted at the angle of inclination $\theta$ of zero (0) degree. This series of tests were conducted with a container D having a flat bottom, as shown in FIG. 4. A bath of water was formed on the flat bottom of the container D. The depth t of the water bath in the container D was varied and set at 0.3 mm, 0.5 mm, 3 mm and 5 mm. Amounts of fused salt, which were classed into 1 gram, 3 grams, 5 grams, 20 grams and 30 grams, were poured or dropped onto the water bath in the container D. Similar tests were conducted five times for each combination of the different water depths t and the different weights W of the salt. The results of these third series of tests are shown in table 3.

TABLE 1

(Results of First Series of Tests)

| Plate Inclination (Θ degrees) | Water Flow Depth (t mm) | Salt Weight (W grams) | Occurence of Explosion (times) | Magnitude of Explosion | Safety assured |
|---|---|---|---|---|---|
| | | 1 | 0 | — | Yes |
| | 0.5 | 3 | 0 | — | Yes |
| | | 5 | 0 | — | Yes |
| | | 20 | 0 | — | Yes |
| | | 30 | 0 | — | Yes |
| | | 1 | 0 | — | Yes |
| | | 3 | 0 | — | Yes |
| 5 | 3 | 5 | 0 | — | Yes |
| | | 20 | 0 | — | Yes |
| | | 30 | 0 | — | Yes |
| | | 1 | 0 | — | Yes |
| | | 3 | 0 | — | Yes |
| | 5 | 5 | 2 | Weak | Yes |

TABLE 1-continued (Results of First Series of Tests)

| Plate Inclination (Θ degrees) | Water Flow Depth (t mm) | Salt Weight (W grams) | Occurence of Explosion (times) | Magnitude of Explosion | Safety assured |
|---|---|---|---|---|---|
| | | 20 | 1 | Minor | Yes |
| | | 30 | 1 | Minor | Yes |
| | | 1 | 0 | — | Yes |
| | | 3 | 0 | — | Yes |
| | 0.5 | 5 | 0 | — | Yes |
| | | 20 | 0 | — | Yes |
| | | 30 | 0 | — | Yes |
| | | 1 | 0 | — | Yes |
| | | 3 | 0 | — | Yes |
| 20 | 3 | 5 | 0 | — | Yes |
| | | 20 | 0 | — | Yes |
| | | 30 | 0 | — | Yes |
| | | 1 | 0 | — | Yes |
| | | 3 | 0 | — | Yes |
| | 5 | 5 | 0 | — | Yes |
| | | 20 | 0 | — | Yes |
| | | 30 | 0 | — | Yes |
| | | 1 | 0 | — | Yes |
| | | 3 | 0 | — | Yes |
| | 0.5 | 5 | 0 | — | Yes |
| | | 20 | 0 | — | Yes |
| | | 30 | 0 | — | Yes |
| | | 1 | 0 | — | Yes |
| | | 3 | 0 | — | Yes |
| 35 | 3 | 5 | 0 | — | Yes |
| | | 20 | 0 | — | Yes |
| | | 30 | 0 | — | Yes |
| | | 1 | 0 | — | Yes |
| | | 3 | 0 | — | Yes |
| | 5 | 5 | 0 | — | Yes |
| | | 20 | 0 | — | Yes |
| | | 30 | 0 | — | Yes |
| | | 1 | 0 | — | Yes |
| | | 3 | 0 | — | Yes |
| | 0.5 | 5 | 0 | — | Yes |
| | | 20 | 0 | — | Yes |
| | | 30 | 0 | — | Yes |
| | | 1 | 0 | — | Yes |
| | | 3 | 0 | — | Yes |
| 45 | 3 | 5 | 0 | — | Yes |
| | | 20 | 0 | — | Yes |
| | | 30 | 0 | — | Yes |
| | | 1 | 0 | — | Yes |
| | | 3 | 0 | — | Yes |
| | 5 | 5 | 0 | — | Yes |
| | | 20 | 0 | — | Yes |
| | | 30 | 0 | — | Yes |
| | | 1 | 0 | — | Yes |
| | | 3 | 0 | — | Yes |
| | 0.5 | 5 | 0 | — | Yes |
| | | 20 | 0 | — | Yes |
| | | 30 | 0 | — | Yes |
| | | 1 | 0 | — | Yes |
| | | 3 | 0 | — | Yes |
| 60 | 3 | 5 | 0 | — | Yes |
| | | 20 | 0 | — | Yes |
| | | 30 | 0 | — | Yes |
| | | 1 | 0 | — | Yes |
| | | 3 | 0 | — | Yes |
| | 5 | 5 | 0 | — | Yes |
| | | 20 | 0 | — | Yes |
| | | 30 | 0 | — | Yes |

TABLE 2

(Results of Second Series of Tests)

| Plate Inclination (Θ degrees) | Water Flow Depth (t mm) | Salt Weight (W grams) | Occurence of Explosion (times) | Magnitude of Explosion | Safety Assured |
|---|---|---|---|---|---|
| | | 1 | 0 | — | Yes |
| | | 3 | 0 | — | Yes |
| 5 | 7 | 5 | 5 | Strong | No |
| | | 20 | 5 | Strong | No |
| | | 30 | 5 | Violent | No |

TABLE 2-continued (Results of Second Series of Tests)

| Plate Inclination (Θ degrees) | Water Flow Depth (t mm) | Salt Weight (W grams) | Occurence of Explosion (times) | Magnitude of Explosion | Safety Assured |
|---|---|---|---|---|---|
| | | 1 | 0 | — | Yes |
| | | 3 | 0 | — | Yes |
| 20 | 7 | 5 | 5 | Strong | No |
| | | 20 | 4 | Violent | No |
| | | 30 | 5 | Violent | No |
| | | 1 | 0 | — | Yes |
| | | 3 | 0 | — | Yes |
| 35 | 7 | 5 | 2 | Strong | No |
| | | 20 | 3 | Violent | No |
| | | 30 | 3 | Violent | No |

TABLE 3

(Results of Third Series of Tests)

| Plate Inclination (Θ degrees) | Water Flow Depth (t mm) | Salt Weight (W grams) | Occurence of Explosion (times) | Magnitude of Explosion | Safety Assured |
|---|---|---|---|---|---|
| | | 1 | 0 | — | Yes |
| | | 3 | 0 | — | Yes |
| | 0.3 | 5 | 5 | Minor | Yes |
| | | 20 | 5 | Strong | No |
| | | 30 | 5 | Strong | No |
| | | 1 | 0 | — | Yes |
| | | 3 | 1 | Weak | Yes |
| 0 | 0.5 | 5 | 5 | Minor | Yes |
| | | 20 | 5 | Strong | No |
| | | 30 | 5 | Strong | No |
| | | 1 | 0 | — | Yes |
| | | 3 | 0 | — | Yes |
| | 3 | 5 | 5 | Minor | Yes |
| | | 20 | 5 | Strong | No |
| | | 30 | 5 | Violent | No |
| | | 1 | 0 | — | Yes |
| | | 3 | 1 | Weak | Yes |
| | 5 | 5 | 5 | Strong | No |
| | | 20 | 5 | Violent | No |
| | | 30 | 5 | Violent | No |

In tables 1, 2 and 3, the word or mark "Weak" in the column of "Magnitude of Explosion" indicates an explosion of such a magnitude as to produce a faint explosive sound. A "Minor" explosion is an explosion of such a magnitude as to make a noticable crackling sound. The "Strong" explosion is an explosion of such a magnitude as to produce a relatively loud sound, while the "Violent" explosion is an explosion of such a magnitude as to produce a violent explosive blast. The "Yes" and "No" in the column of "Safety Assured" have been decided such that "Yes" is given both to a case where no explosion occurs and to the "Weak" and "Minor" explosions, whereas "No" is given to the "Strong" and "Violent" explosions.

It has been seen from the test results that, in the cases where the masses of salt which fall onto water were as light as around 3 grams, no explosion took place irrespective of the angle of inclination $\theta$ of the plate A and of the depth t of the water flow on the plate. With salt masses of more than 5 grams, there has been found a tendency that the magnitude of explosions is increased as the amount of salt is increased. With the case of more than 5 grams of salt, however, the occurence of an explosion hardly depends upon the amounts of salt which fall onto water flow. Within the range of the angle of inclination $\theta$ of from 5° to 60°, smelt-water explosion hardly occurs even with the water flow depth of 5 mm (should an explosion take place, such an explosion would be of a quite weak magnitude and by no means dangerous). The increase in the angle of inclination $\theta$ results in the decrease in the efficiency of the cooling of masses of salt on the inclined plate A. The increase in the water flow depth t, however, does not result in an increase in the possibility of occurence of an explosion on the inclined plate A. In addition, the inclined plate can be longitudinally extended to provide an adequate cooling of salt masses thereon even in the case where the angle of inclination $\theta$ is of a relatively increased value. From the view point of the size of the apparatus, however, a preferred range of the angle of inclination of the inclined plate A is from 5° to 60°.

More specifically, incinerators commonly used are axially elongated, i.e., from about 2.5 m to about 3 m in diameter and from about 8 m to about 10 m in axial length or height. The gas-liquid separator which is to be connected to such an axially elongated incinerator is limited to as high as from about 1.5 m to about 2 m to assure an adequate mechanical strength of the entire apparatus. An increase in the angle of inclination of the top surface of the baffle member will result in the increase in the height of the gas-liquid separator, with a disadvantageous resultant increase in the difficulty in the installation of the separator. With the angle of inclination of from 5° to 60°, however, the gas-liquid separator will not have to be of an increased height and thus can be installed relatively easily. The gas-liquid separator vessel of the embodiment illustrated in FIG. 1 is particularly preferred not only because the vessel can accomodate the baffle member even at a very small angle of inclination but also because the efficiency of removing dust from the gaseous mixture to be discharged through the gas outlet is increased. A satisfactory result will be obtained from the cylindrical gas-liquid separator vessel of from 4 to 5 m in axial length. A vessel of such dimension and shape is very advantageous as compared with a vessel of another shape and of an increased height.

FIG. 4 graphically illustrates the results of the first to third series of tests. Within the hatched area of the graph, fused salt can be cooled by water without any destructive explosion. Especially within the area hatched with a grid pattern, fused salt can be sufficiently cooled on the inclined plate A.

The test results exemplify that, within the preferred range of the angle of inclination $\theta$ of the plate A discussed above and within the preferred range of the depth t of the water flow on the plate, handling of the fused salt with the apparatus shown in FIG. 1 can be conducted without explosion. Namely, the baffle member 56 of the apparatus 10 can be positioned such that the angle of inclination $\beta$ of the top surface of the baffle member 56 is within the preferred range of the angle of inclination $\theta$ discussed above. In addition, the water supply to the apparatus through the pipelines 37 and 67 can be controlled such that the depth of the water flow on the inclined surface of the baffle member 56 is within the preferred range of the water flow depth t discussed above. In addition, it has been found from the test results that the supply of the cooling water to the fused salt through the pipeline 37 and through the nozzles 32 is not essential for the necessary cooling of the fused salt by water. It will be remembered that weighed amounts of fused salt were dropped directly onto water flows in the first to third series of tests. Accordingly, in the case where no water is fed through the pipeline 37 and through the nozzles 32 to the flow of fused salt through the annular wall 30 which is disposed between the incinerator 12 and the gas-liquid separator 40, the annular wall 30 can be eliminated from the apparatus and, instead, the open bottom of the incinerator 12 can be connected directly to the inlet 42' formed in the vessel 42 of the gas-liquid separator 40.

Figure 6:
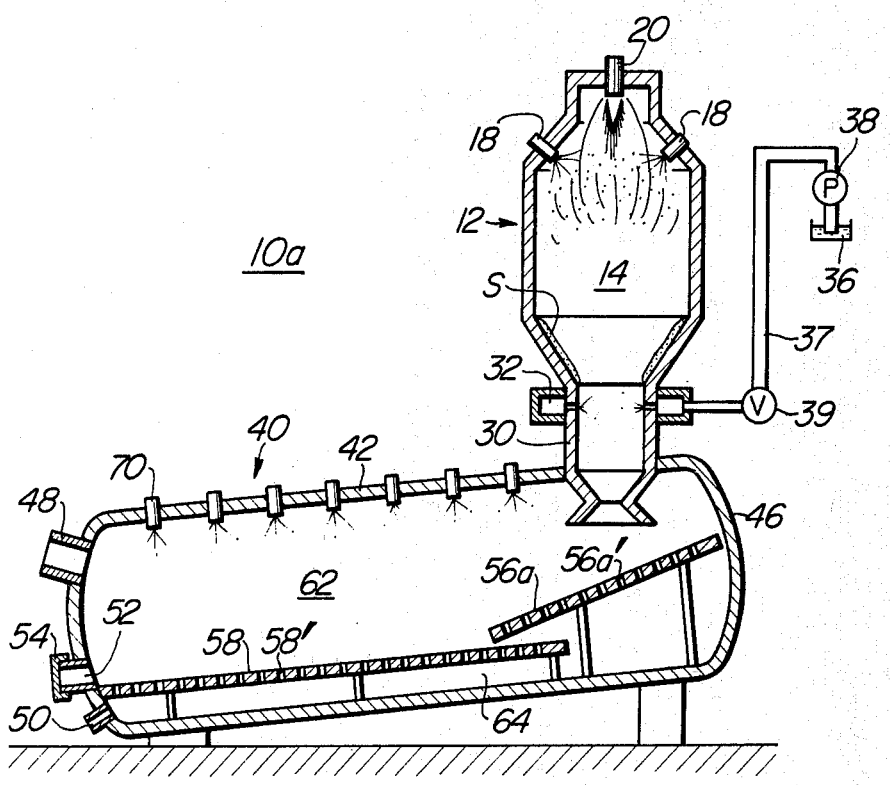
FIG. 6 is similar to FIG. 1 but illustrates another embodiment of the apparatus according to the present invention.

FIG. 6 illustrates a second embodiment of the apparatus generally designated by 10*a*. Similar parts are designated by similar reference numerals. The differences only will be discussed hereunder. In the embodiment 10*a*, the cooling water is supplied only through the water supply nozzles 32 provided in the annular wall 30. A baffle member 56*a* is disposed in the gas-liquid separator vessel 40 beneath the bottom end of the annular wall 30 and formed therein with perforations or apertures 56*a'*. The size of the apertures 56*a'* is determined such that masses of salt of larger than about 3 grams do not pass through the apertures onto the bottom of the vessel 40. The aperture size is also dependent on the angle of inclination of the baffle member 56*a* to the horizontal and preferably ranges from 1 mm to 30 mm. The number of the apertures 56*a'* in the baffle member 56*a* should be determined in relation to the rate of supply of the cooling water onto the baffle member 56*a*. Preferably, the density of the apertures 56' in the baffle member 56*a* may be higher in the upper zone of the baffle member than in the lower zone thereof to assure a substantially uniform depth of water flow on the baffle member 56*a*. The ratio of the total of the open areas of the apertures 56*a'* to the whole surface area of the baffle member 56*a* may preferably range from 20% to 50%.

Figure 7:
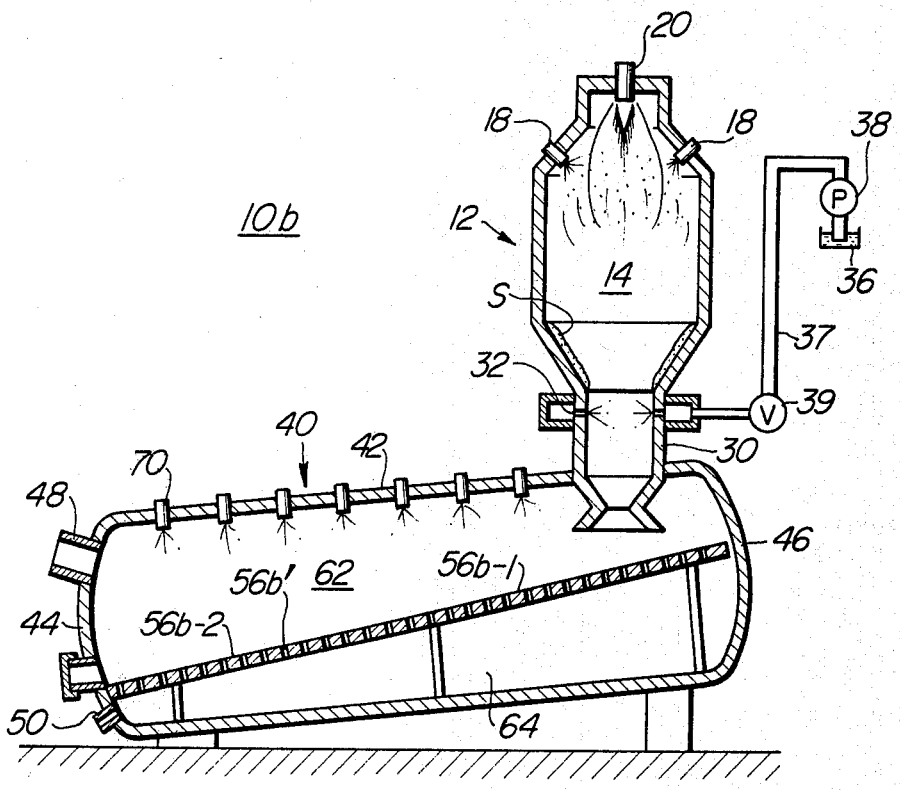
FIG. 7 is a similar view but illustrates a further embodiment of the apparatus according to the present invention.

FIG. 7 illustrates a third embodiment of the apparatus generally designated by 10*b*. The embodiment 10*b* is similar in structure to the embodiment 10*b* shown in FIG. 6 with only one exception that the embodiment 10*b* does not include a partition 58 and, instead, a substantially flat baffle member 56*b* extends substantially entirely across the interior of the gas-liquid separator vessel 40 to cooperate therewith to define upper and lower sections 62 and 64 for gases and liquid, respectively. The baffle member 56*b* is inclined at an angle to the horizontal and comprises an upper section 56*b*-1 disposed and extending beneath the bottom end of the annular wall 30 and a lower section 56*b*-2 which is integral and continuous with the upper section 56*b*-1 and disposed and extending beneath the series of water shower nozzles 70. In other words, the baffle member 56*b* of the embodiment 10*b* acts as both the baffle member 56*a* and the partition 58 of the embodiment 10*a* shown in FIG. 6. In the embodiment 10*b* shown in FIG. 7, the baffle member 56*b* is formed with apertures 56*b'* throughout its whole surface area. The size and density of the apertures 56*b'* may be variable from one zone to another.

What is claimed is:

1. An improved method of treating a water solution of a waste material containing a salt having smelt-water explosion characteristics, said method including the steps of spraying the waste solution into an open-bottomed incinerator, producing a combustion of a fuel in said incinerator to heat the spray of the waste solution to a temperature at which the water in the sprayed solution is vaporized and the salt contained in the sprayed solution is fused, causing at least a part of the fused salt to form a layer on the inner surface of said incinerator, allowing the fused salt in said layer to flow downwardly by gravity through the open bottom of said incinerator, and cooling the fused salt to a temperature at which no explosion occurs, wherein the improvement comprises:

establishing an inclined flow of cooling water which is disposed below said open bottom of said incinerator and intersects the vertical axis of said open bottom so that the fused salt falls down onto said inclined water flow and which is of a depth ranging from 05. to 5.0 mm, the angle of inclination of said water flow relative to the horizontal ranging from 5° to 60°.

* * * * *

UNITED STATES PATENT AND TRADEMARK OFFICE

CERTIFICATE OF CORRECTION

PATENT NO. : 4,351,252

DATED : Sepetember 28, 1982

INVENTOR(S) : Mamoru Shindome et al

It is certified that error appears in the above—identified patent and that said Letters Patent is hereby corrected as shown below:

| | |
|---|---|
| Col. 1, line 20 | Delete "termperature" and insert --temperature-- |
| Col. 2, line 1 | Delete "is" and insert --in-- |
| Col. 6, line 60 | Delete "paarallel" and insert --parallel-- |
| Col. 12, line 25 | Delete "56'" and insert --56a'-- |

Signed and Sealed this

Seventh Day of December 1982

[SEAL]

*Attest:*

GERALD J. MOSSINGHOFF

*Attesting Officer* *Commissioner of Patents and Trademarks*